United States Patent [19]

Petersen

[11] 4,020,736

[45] May 3, 1977

[54] AUTOMATIC INCREMENT SIZER-FEEDER FOR PRESS LOADING

[75] Inventor: Robert Petersen, Williamsburg, Va.

[73] Assignee: The United States of America as represented by the Secretary of the Navy, Washington, D.C.

[22] Filed: Mar. 29, 1976

[21] Appl. No.: 671,524

[52] U.S. Cl. ..... 86/20 B; 86/29

[51] Int. Cl.[2] ..... F42B 33/02

[58] Field of Search ..... 86/20 R, 1 R, 20 A, 86/20 B, 20 C, 20 D, 23, 29, 30, 31; 141/71, 73; 53/124 B

[56] References Cited

UNITED STATES PATENTS

| | | | |
|---|---|---|---|
| 1,346,064 | 7/1920 | Remmen | 86/20 B |
| 1,372,009 | 3/1921 | Davidson et al. | 86/20 R |
| 2,395,898 | 5/1946 | Mohr | 86/20 B |
| 2,515,323 | 7/1950 | Stuart | 86/20 R |
| 2,655,831 | 10/1953 | Veum | 86/31 |
| 2,927,499 | 3/1960 | Mog et al. | 86/31 X |

*Primary Examiner*—Harold Tudor

[57] ABSTRACT

An automatic press for loading and tamping powdered explosive material in projectile casings. An increment feeder operates in synchronism with the press and feeds successively smaller increments of explosive into the casing, as the casing fills, until the fill cycle is completed.

3 Claims, 1 Drawing Figure

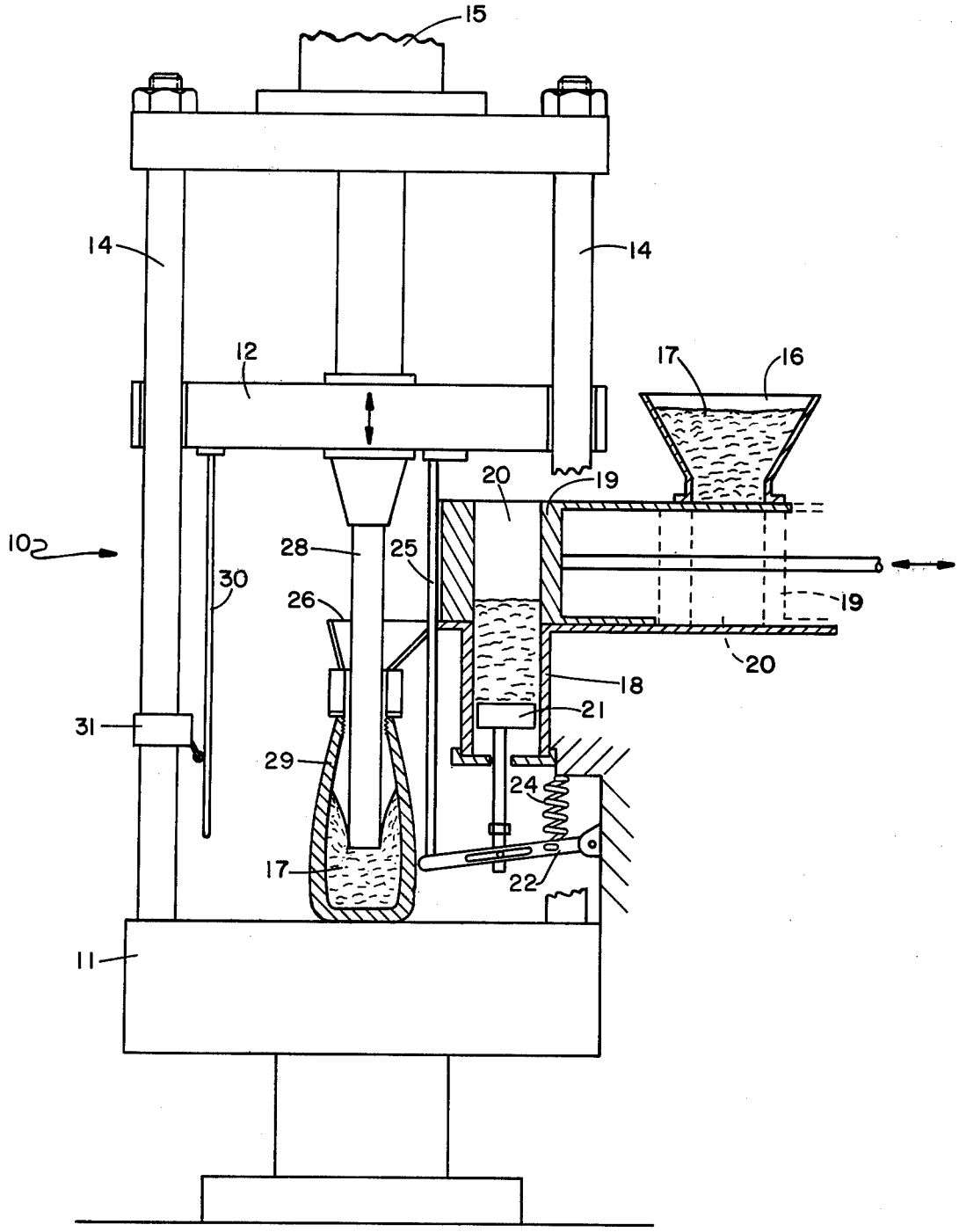
15
14
14
12
17
16
20
19
10
28
25
30
26
19
20
18
21
31
29
24
17
22
11

AUTOMATIC INCREMENT SIZER-FEEDER FOR PRESS LOADING

BACKGROUND OF THE INVENTION

This invention relates generally to press loading of projectiles and more particularly to an automatic press which senses the volume remaining to be filled and automatically sizes fill increments accordingly.

In the past, projectiles have been press loaded using the following technique. Explosive powder is poured into a projectile and compacted. Additional weighed powder increments of various sizes are manually poured into the projectile and compacted until the compacted explosive level nears the nose of the projectile. The depth of that level from the nose is measured and then, an estimated weight of powder, based on that measurement, is poured into the projectile to bring the final compaction level to a prescribed depth from the nose. Approximately six weighted increments are needed to complete loading of a projectile. The weight of the last increment is varied to compensate for the variations in internal volumes of the projectile.

SUMMARY OF THE INVENTION

The present invention overcomes the disadvantages of the aforedescribed technique by providing an automatic press having an increment feeder which successively feeds smaller increments of powdered explosive on a volumetric basis thereby obviating the necessity for manual weighing of successive increments.

BRIEF DESCRIPTION OF THE DRAWING

The single FIGURE of the drawing illustrates an automatic projectile loading press embodying the principal features of the present invention.

DESCRIPTION OF THE PREFERRED EMBODIMENT

Referring now to the drawing there can be seen a hydraulic press 10 having a fixed lower platen 11 and an upper platen 12 reciprocably movable along guides 14 by means of a hydraulic cylinder 15 and conventional controls (not shown). A hopper 16 is fixed to the press 10 for holding powdered or granular explosives 17. An increment fill cylinder 18 is also fixed to the press. A feed shoe 19 having a cavity 20 therein is reciprocable between a loading position beneath the hopper 16 and an unloading position above the fill cylinder 18.

A piston 21 is disposed within the cylinder 18 and movable therein by means of linkage 22 and a tension spring 24. An adjustable fill rod 25 is carried by the movable platen 12 and engages the linkage 22 to effect movement of the piston 21. A loading dome 26 is fixed to the cylinder and aligned with a ram 28 carried by the movable platen 12. The dome 26 encompasses the fuze end of a projectile casing 29 which rests on the fixed platen 11. A sensing rod 30 engages a limit switch 31 during successive strokes of the ram 28 until sufficient powder 17 is in the projectile 29 to preclude further tripping of the switch 31 at which time the loading cycle is complete.

OPERATION

In order that a better understanding of the invention might be had, its mode of operation will now be described. A projectile casing 29 is placed on the fixed platen 11 in line with the loading dome 26 and the hopper 16 is filled with powdered explosive 17. At this time the feed shoe 19 is positioned below the hopper 16 so that the cavity 20 fills with explosive 17. The movable platen 12 is moved to its lowest position causing the fill rod 25 to move the piston 21 to the bottom of the cylinder 18 through the linkage 22 and then the feed shoe 19 is indexed to the left to allow the explosive 17 in the cavity 20 to fall into the fill cylinder 18. The feed shoe 19 is then retracted to its loading position and the ram 28 retracted allowing the piston 21 to move upwardly forcing the explosive 17 out of the fill cylinder 18.

The feed shoe 19 is again indexed to the unloading position above the cylinder 18 and this movement causes the left hand face (as shown in the drawings) of the feed shoe 19 to push the explosive 17 into the loading dome 26 from which it falls into the projectile casing 29. The ram 28 is again indexed downward to compact the explosive 17 within the projectile casing 29. The downward travel of the ram 28 will be limited due to the presense of explosive 17 beneath the ram. This limitation of ram travel may be accomplished by using a pressure relief valve (not shown) in the hydraulic system for the hydraulic cylinder 15 or by any of various other means. This limitation of ram travel also limits the travel of the piston 21 within the fill cylinder 18 which determines the size of the next increment of explosive which will be ejected by the piston 21 and pushed into the loading dome 26 by the feed shoe 19. Thus the successive increments of explosive 17 loaded into the projectile casing 29 are proportional to the volume remaining to be filled. When the projectile casing 29 is filled to the proper level, the limit switch 31 is no longer tripped by the sensing rod 30 and the loading cycle is complete.

It is thus apparent that the present invention provides many advantages not found in prior art devices or techniques. Formerly, press loading of explosives in projectiles was done in barricaded cells to afford protection to pressing personnel and access to such cells was through substantial blast doors. The present invention eliminates weighing of explosive increments, measuring increment height, and pouring of increments by personnel. By automating the press loading cycle, a substantial increase in production rate is accomplished. One unique feature of the present invention is that increments are sized and provided automatically, by sensing (i.e., ram intrusion into projectile) the volume of the remaining projectile void to be filled.

Obviously, many modifications and variations of the present invention are possible in the light of the above teachings. For example, adjustable, proportional movement of the piston in the fill cylinder can readily be achieved by adjustable linkages, variable gearing, potentiometer controlled devices, etc. to compensate for various ram and fill cylinder diameters as well as various bulk densities of different powdered explosives. It is therefore to be understood that within the scope of the appended claims the invention may be practiced otherwise than as specifically described.

What is claimed is:

1. An automatic press for loading projectiles with powdered explosive comprising:

a fixed lower platen for supporting projectile cases to be loaded;

an upper platen movable toward and away from said lower platen;

a hopper for holding a supply of powdered explosive;

variable means for feeding increments of explosive into the projectile on said lower platen;

a ram carried by said upper platen for compacting explosive in said projectile; and means for adjusting said variable feeding means in response to the extent of ram travel into the projectile whereby the size of the succeeding increment of explosive is directly proportional to the void volume remaining in the projectile.

2. An automatic press as defined in claim 1 wherein said variable feeding means comprises:

a variable volume increment fill cylinder;

a feed shoe having an explosive receiving cavity therein and reciprocable between a loading position below said hopper and an unloading position above said fill cylinder; and feed ajusting means for ejecting the measured increment from said fill cylinder into the path of the returning feed shoe whereby said feed shoe transfers measured increments of explosive from said fill cylinder to said projectile while simultaneously delivering the next increment to said fill cylinder.

3. An automatic press as defined in claim 2 wherein said adjusting means comprises:

a piston movable within said fill cylinder and forming the bottom thereof;

linkage fixed to said lower platen and coupled to said piston for moving said piston; and a fill rod fixed to said upper platen and movable therewith for engaging said linkage and moving said piston whereby the volume of said fill cylinder varies directly with the extent of movement of said ram.

* * * * *